US012638214B2

(12) United States Patent
Patil et al.

(10) Patent No.: US 12,638,214 B2
(45) Date of Patent: May 26, 2026

(54) WIND DRIVEN RAIN LOUVER

(71) Applicant: Air Distribution Technologies IP, LLC, Milwaukee, WI (US)

(72) Inventors: Vikas Patil, Jaysingpur (IN); Joseph S. Rockhold, Bates City, MO (US); Vahe Michael Astourian, Lee's Summit, MO (US); James Smardo, Kansas City, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 390 days.

(21) Appl. No.: 18/211,144

(22) Filed: Jun. 16, 2023

(65) Prior Publication Data

US 2023/0408139 A1 Dec. 21, 2023

Related U.S. Application Data

(60) Provisional application No. 63/352,909, filed on Jun. 16, 2022.

(51) Int. Cl.
*F24F 13/15* (2006.01)
*F24F 13/14* (2006.01)

(52) U.S. Cl.
CPC ..... *F24F 13/15* (2013.01); *F24F 13/1406* (2013.01)

(58) Field of Classification Search
CPC ..... F24F 13/15; F24F 13/1406; F24F 13/072; F24F 13/082; F24F 13/08; F24F 13/1413; F24F 13/1486; F24F 13/10
USPC ..... 454/358, 369, 309–321, 347–353, 454/299–300, 277–283, 245–248; 169/96; 49/92.1
See application file for complete search history.

(56) References Cited

U.S. PATENT DOCUMENTS 3,682,084 A * 8/1972 Tarnoff ..... F24F 13/08 454/359
11,993,361 B2 * 5/2024 Parks ..... B64C 29/0025
2021/0172646 A1 6/2021 Patil et al.

OTHER PUBLICATIONS

Architectural Louver Catalog, Ruskin, Apr. 11, 2018, p. 1-64, 3900 Dr. Greaves Rd. Kansas City, MO 64030, https://www.ruskin.com/doc/id/6935.

* cited by examiner

*Primary Examiner* — Vivek K Shirsat
(74) *Attorney, Agent, or Firm* — Michael Best & Friedrich LLP

(57) ABSTRACT

A louver blade for a louver assembly includes a first segment and a second segment, where the second segment is adjustable relative to the first segment to selectively contact the first segment, the second segment is configured to reduce an amount of free area between adjacent louver blades of the louver assembly in a first position of the second segment, and the second segment is configured to increase the amount of free area between adjacent louver blades of the louver assembly in a second position of the second segment.

17 Claims, 8 Drawing Sheets

WIND DRIVEN RAIN LOUVER

CROSS-REFERENCE TO RELATED APPLICATIONS

This application claims priority from and the benefit of U.S. Provisional Application No. 63/352,909, entitled "A WIND DRIVEN RAIN LOUVER," filed Jun. 16, 2022, which is herein incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to and/or ventilated from a space. For example, the HVAC system may place the air flow in a heat exchange relationship with a refrigerant of a vapor compression circuit. The air flow may be directed through the HVAC system via a louver assembly. The louver assembly may include blades that are implemented to block certain elements, such as debris and precipitation, from flowing through the louver assembly. It is recognized that an improved louver assembly design is desirable to increase blockage of elements while enabling desired air flow through the louver assembly.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a louver blade for a louver assembly includes a first segment and a second segment, where the second segment is adjustable relative to the first segment to selectively contact the first segment, the second segment is configured to reduce an amount of free area between adjacent louver blades of the louver assembly in a first position of the second segment, and the second segment is configured to increase the amount of free area between adjacent louver blades of the louver assembly in a second position of the second segment.

In another embodiment, a louver assembly for a heating, ventilation, and air conditioning (HVAC) system includes a louver blade comprising a first segment and a second segment, wherein the second segment is adjustable, relative to the first segment, between a first position and a second position, the second segment is configured to reduce an amount of free area through the louver assembly in the first position, and the second segment is configured to increase the amount of free area through the louver assembly in the second position and a controller configured to transition the second segment between the first position and the section position.

In another embodiment, a louver blade for a louver assembly includes an upstream segment comprising a first extension, a downstream segment comprising a second extension and a third extension, wherein the downstream segment is configured to rotate relative to the upstream segment between a first position and a second position, and a seal disposed within a recess of the second extension, wherein the seal is configured to engage with the first extension of the upstream segment in the first position of the downstream segment.

DETAILED DESCRIPTION

Figure 1:
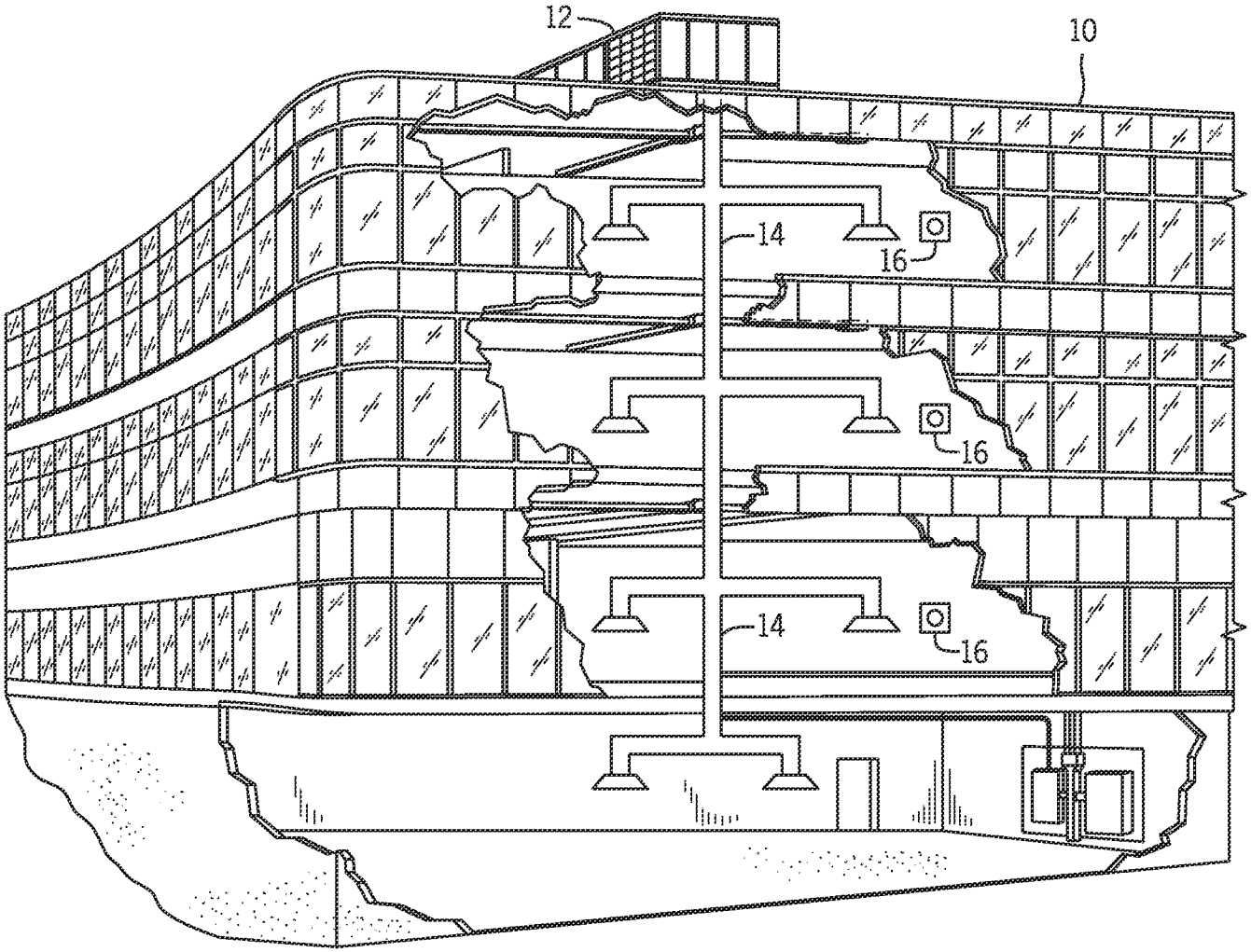
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, two components having respective axes that are "parallel" with one another is intended to encompass the axes of the components extending substantially parallel to each other (e.g., within related tolerances) without definitively being mathematically parallel.

The present disclosure is directed to a louver assembly for a heating, ventilation, and/or air conditioning (HVAC) system. The louver assembly may enable air flow into and/or out of the HVAC system or another enclosed space. For instance, the louver assembly may be disposed at an inlet of the HVAC system to enable control of an air flow from an ambient environment into the HVAC system. The HVAC system may condition the air flow by adding and/or removing heat from the air flow. The louver assembly may additionally or alternatively be disposed at an outlet of the HVAC system to enable control of an air flow directed out of the HVAC system, such as to condition a space serviced by the HVAC system and/or to discharge an exhaust air flow. In further embodiments, the louver assembly may be configured to control an air flow within the HVAC system, such as between different components or portions of the HVAC system.

The louver assembly may include a frame (e.g., defined by frame segments) and blades secured to the frame. The frame may be coupled to another component of the HVAC system, such as to an air handler, ductwork, a support structure, a housing, and/or a heat exchanger, to enable control of air flow through the HVAC system. The blades may be disposed within the frame and may be arranged to block solid and/or liquid particles, including precipitation, dirt, and/or other debris, from passing through the louver assembly and into the HVAC system or another enclosed space. Indeed, it may be desirable to block solid and/or liquid particles from entering the HVAC system or enclosed space. For instance, the louver assembly may be subject to various standards and/or certifications indicative of an ability of the louver assembly to block solid and/or liquid elements from passing through the louver assembly. As an example, the louver assembly may be subject to criteria of the Air Movement and Control Association International, Inc. (AMCA) 550 standard for wind-driven rain resistance, in which the performance of the louver assembly during simulated rainfall at various wind speeds (e.g., 35 miles per hour, 70 miles per hour, 90 miles per hour, 110 miles per hour) is evaluated. The performance of the louver assembly may be assessed based on an amount or rate of water (e.g., 22 centimeters or 8.8 inches per hour) that passes through the louver assembly during simulated conditions. Certain blades of existing louver assemblies may not adequately block solid and/or liquid particles from passing through the louver assemblies. For example, the solid and/or liquid particles may pass through openings of the louver assembly formed between the blades. In other existing louver assemblies, blades may not enable sufficient air flow through the louver assemblies. For instance, traditional louver assemblies include a plurality of fixed blades arranged relative to a louver frame. The fixed louver blades may provide resistance to incoming air flow to reduce ingress of solid and/or liquid particles. However, louver assemblies with fixed louver blades may be associated with less free area (e.g., area for an air flow to pass through the louver assembly), which reduces the incoming airflow directed into an HVAC system. Further, the geometry of the blades may impart an elevated pressure drop that blocks and/or inhibits air from flowing through the louver assemblies at a desirable flow rate, thereby increasing a load on the HVAC system in which the louver assembly is employed.

Thus, it is presently recognized that a louver assembly with blades designed to adequately or desirably block solid and/or liquid particles from flowing through the louver assembly while enabling air to flow through the louver assembly at a desirable flow rate and/or at a reduced pressure drop may improve performance of the louver assembly and of an HVAC system incorporating the louver assembly. Accordingly, embodiments of the present disclosure are directed to a louver assembly having louver blades that include a first section or portion that is fixed relative to a frame in which the louver blade is disposed and a second section or portion that is movable relative to the first section or portion of the louver blade. In this way, the louver assembly (e.g., louver blade) may transition between a first configuration and a second configuration, such as based on certain environmental conditions. For example, the louver assembly may be transitioned to a first configuration during stormy (e.g., amount or rate of precipitation greater than a threshold value) and/or windy (e.g., flow rate of wind greater than a threshold value) conditions and may be transitioned to a second configuration during dry (e.g., amount or rate of precipitation less than a threshold value) and/or calm (e.g., flow rate of wind less than a threshold value) conditions. In this way, components of the louver blades may enable increased blockage of solid and/or liquid particles through the louver assembly in the first configuration (e.g., reduced amount of free area) and openings of the louver assembly formed between adjacent louver blades may enable an increased amount of air flow through the louver assembly in the second configuration (e.g., increased amount of free area) to enable the HVAC system to operate desirably. In certain embodiments, each louver blade may also include a seal disposed between the first section or portion and the second section or portion, and the seal may be configured to limit ingress or flow of solid and/or liquid particles and/or debris through a recess formed between the first section or portion and the second section or portion, as described in greater detail below. Additionally, each of the louver blades may include extensions configured to function as barriers that block solid and/or liquid particles from flowing across the louver blades. Further, each louver blade may include recesses that retain solid and/or liquid particles and that direct the solid and/or liquid particles toward jamb frames of the louver assembly. The jamb frames may then direct the solid and/or liquid particles out of the louver assembly and away from the HVAC system or enclosed space.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10 and/or on a side of the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 in the illustrated embodiment is an air cooled device that implements a refrigeration or vapor compression cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

As discussed above, the present disclosure is directed to a louver assembly that includes a frame or a frame assembly and louver blades having a geometry and configuration that enables desired flow of air through the louver assembly while also blocking solid and/or liquid particles from flowing through the louver assembly. For example, the louver blades may include extensions that form recesses configured to receive, capture, or retain solid and/or liquid particles. The louver blades may also include features, such as protrusions, that retain the solid and/or liquid particles within the recesses. The frame or frame assembly may include a jamb frame coupled to the louver blades. The jamb frame may have channels that align with the recesses of the louver blades, and the channels may receive the solid and/or liquid particles captured or retained by the louver blades via the recesses. The channels may then discharge the solid and/or liquid particles out of the louver assembly. Further, the louver blades may be arranged to form openings between adjacent louver blades that enable air to flow through the louver assembly at a desirable flow rate and/or with reduced obstruction. In this manner, the louver blades may enable improved control of air flow through the louver assembly.

Figure 2:
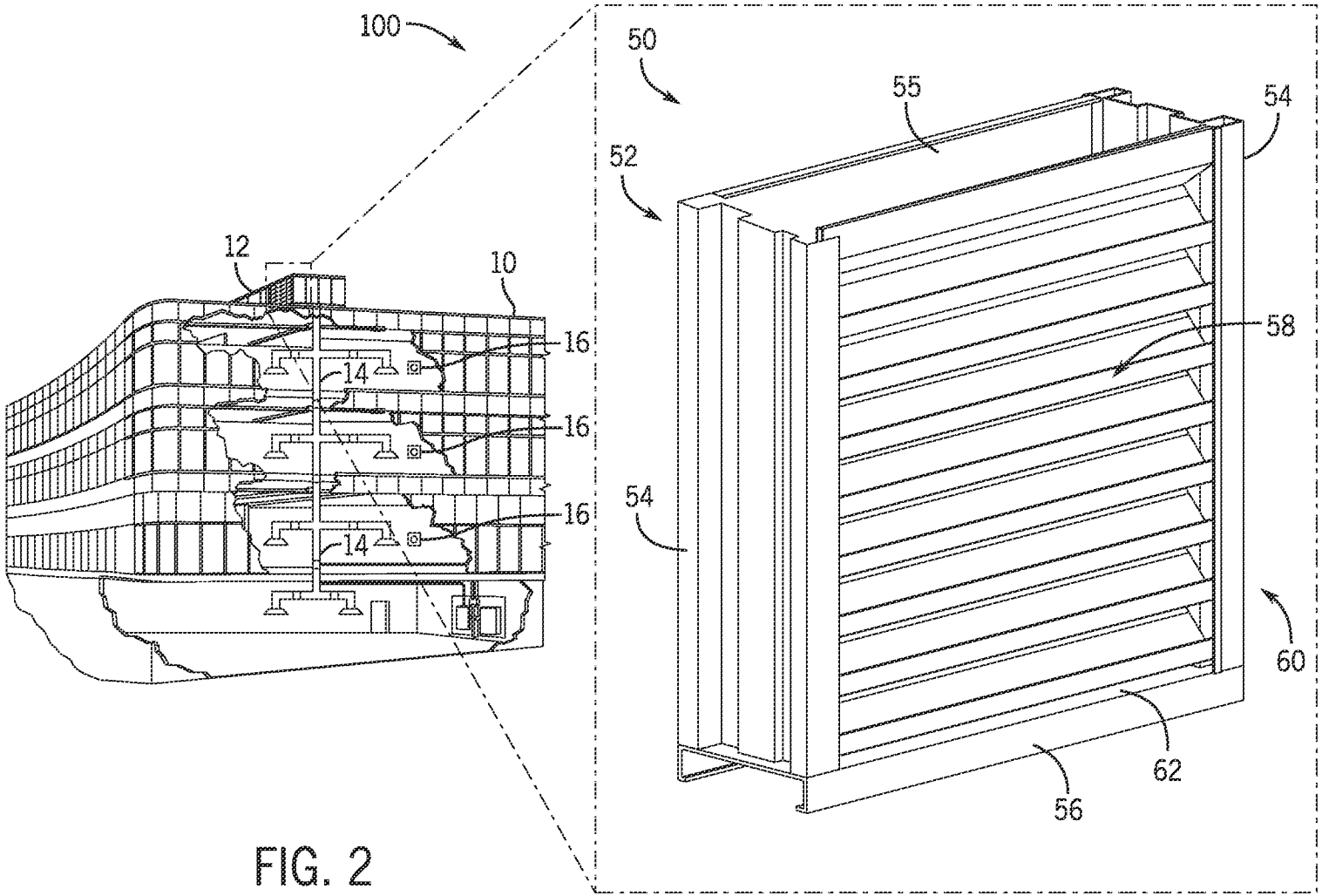
FIG. 2 is a perspective expanded view of an embodiment of a louver assembly that may be incorporated in an HVAC system, in accordance with an aspect of the present disclosure.

With this in mind, FIG. 2 is a perspective view of an embodiment of a louver or a louver assembly 50 that may be incorporated in an HVAC system. For example, the louver assembly 50 may be positioned to control air flow between an ambient environment and an enclosed space, such as an interior of the HVAC unit 12. The air flow may be drawn into the HVAC unit 12 (e.g., for cooling a heat transfer fluid, for use as a supply air flow directed to a space conditioned by the HVAC unit 12) and/or may be discharged from the HVAC unit 12 (e.g., after use in conditioning the space conditioned by the HVAC unit 12). The louver assembly 50 may include a frame assembly 52 (e.g., a frame) defining an air flow path through the louver assembly 50 (e.g., from an upstream location to a downstream location). It should be noted that "upstream," "midstream," and "downstream" may be utilized herein with reference to a direction of air flow through the louver assembly 50. In some embodiments, the frame assembly 52 may include multiple frame members that are coupled one another to define a perimeter of the air flow path or the louver assembly 50. As an example, the frame assembly 52 may include jamb or lateral frames or frame members 54 defining a portion of the perimeter of the air flow path. Each of the jamb frame members 54 may be configured to couple to a head or top frame or frame member 55 and to a sill or base frame or frame member 56. Each of the head frame member 55 and the sill frame member 56 may define additional portions of the perimeter of the air flow path. The jamb frame members 54, the head frame member 55, and the sill frame member 56 are coupled to one another to form a rectangular geometry in the illustrated frame assembly 52. However, in additional or alternative embodiments, the frame assembly 52 may have any other suitable geometry, such as a triangular shape, a trapezoidal shape, a diamond shape, a circular shape, and so forth, and/or may include any suitable number of frame members defining the geometry (e.g., a perimeter) of the frame assembly 52. In any case, the frame assembly 52 may form an opening 60 (e.g., air flow path) through which air may flow.

The louver assembly 50 may further include blades or louver blades 58 that are coupled to the frame assembly 52, such as to the jamb frame members 54. Each of the louver blades 58 may span across the opening 60 (e.g., air flow path through the frame assembly 52). Indeed, the louver blades 58 may be configured to block solid and/or liquid particles (e.g., solid and/or liquid particles carried by the air flow) from passing through the louver assembly 50 via the opening 60. For example, the louver blades 58 may block precipitation, dust, dirt, and/or debris from flowing through the opening 60. In certain embodiments, a first portion of each louver blade 58 may remain fixed relative to the frame assembly 52 (e.g., fixedly attached to the frame assembly 52), while a second portion of each louver blade 58 may be configured to move relative to the frame assembly 52. Thus, each louver blade 58 may transition between a first position or configuration in which the moveable portion of the louver blade 58 is configured to limit an amount of free area between adjacent louver blades 58 and a second position or configuration in which the movable portion of the louver blade 58 is configured to enable an increased amount of free area between adjacent louver blades 58. In some applications, the louver blades 58 may transition (e.g., be actuated) between the first and second positions or configurations based on environmental conditions. For instance, during stormy conditions (e.g., environmental conditions in which rainfall, precipitation, and/or wind is above a threshold value), each louver blade 58 may be oriented in the first position to limit an amount of free area between adjacent louver blades 58, thereby increasing blockage of liquid and/or solid particles through the louver assembly 50. Indeed, in the first position, the movable portion of a respective louver blade 58 may be positioned within an air flow path between adjacent louver blades 58 to enable an increase in an amount of solid and/or liquid particles collected by the louver blades 58. During dry and/or calm conditions (e.g., environmental conditions in which rainfall, precipitation, and/or wind is below a threshold value), each louver blade 58 may be oriented in the second position to increase an amount of free area between adjacent louver blades 58, thereby increasing an amount of air flow through the louver assembly 58 and reducing a pressure drop across the louver assembly 50.

Further, the louver blades 58 may have a shape, contour, or other geometry configured to block the flow of the solid and/or liquid particles through the opening 60. For instance, as further discussed herein, the louver blades 58 may be configured to trap solid and/or liquid particles and to guide the particles toward the jamb frame members 54 in each assembled orientation (e.g., position, configuration) of the louver blades 58, and the jamb frame members 54 may be configured to guide the solid and/or liquid particles to flow out of the louver assembly 50 (e.g., into the ambient environment and away from an interior of the HVAC unit 12) in an installed configuration of the louver assembly 50. For example, the jamb frame members 54 may direct the solid and/or liquid particles onto a surface 62 of the sill frame member 56 via a gravitational force, and the surface 62 may direct the solid and/or liquid particles away from the louver assembly 50 via an opening formed between the sill frame 56 and one of the louver blades 58 adjacent thereto. Additionally, the louver blades 58 may enable air flow through the louver assembly 50 via the opening 60, which may enable efficient operation of the HVAC unit 12. Indeed, openings formed between the louver blades 58 may enable a desired amount or quality of air flow through the louver assembly 50.

Figure 3:
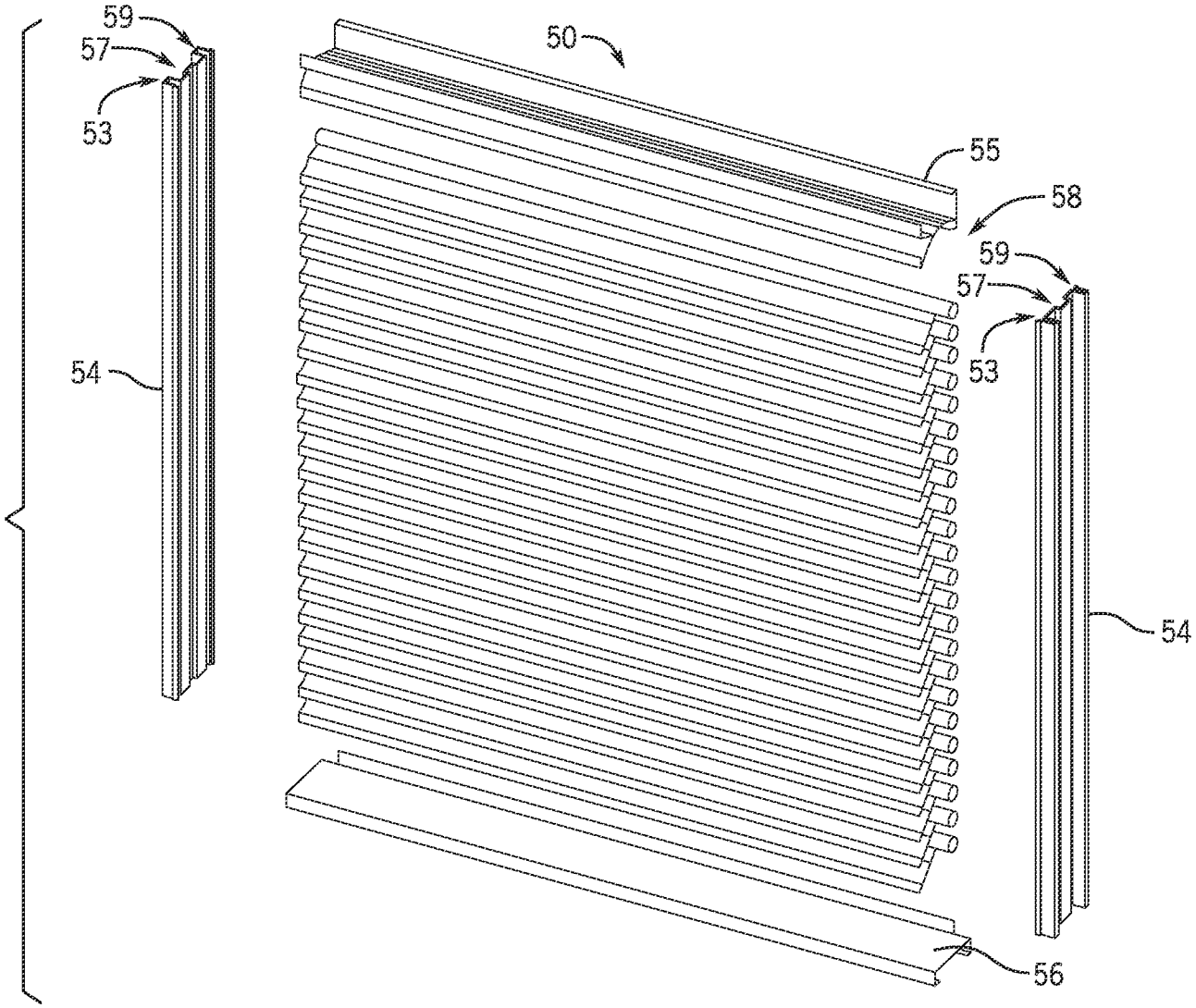
FIG. 3 is an exploded perspective view of an embodiment of a louver assembly that may be incorporated in an HVAC system, in accordance with an aspect of the present disclosure.

FIG. 3 is an exploded perspective view of an embodiment of the louver assembly 50. In the illustrated embodiment, the jamb frame members 54, the head frame member 55, and the sill frame member 56 are separate components configured to couple to one another. For example, fasteners may be used to couple the frame members 54, 56, 55 to one another to form the frame assembly 52. Further, each of the louver blades 58 may be configured to couple to the jamb frame members 54. As an example, opposite ends of each louver blade 58 may be coupled to a respective jamb frame member 54 in the assembled configuration of the louver assembly 50. In the manner described below, solid and/or liquid particles trapped by the louver blades 58 may be guided toward the ends of the louver blades 58 and to the jamb frame members 54. The jamb frame members 54 may then guide the solid and/or liquid particles onto the sill frame member 56 and away from the louver assembly 50 in the manner described above. In certain embodiments, each of the jamb frame members 54 may include a first channel 53, a second channel 57, and a third channel 59 configured to align with one or more cavities or recesses defined by the louver blades 58 to guide the solid and/or liquid particles toward the sill frame member 56 and away from the louver assembly 50, as described in greater detail below.

Figure 4:
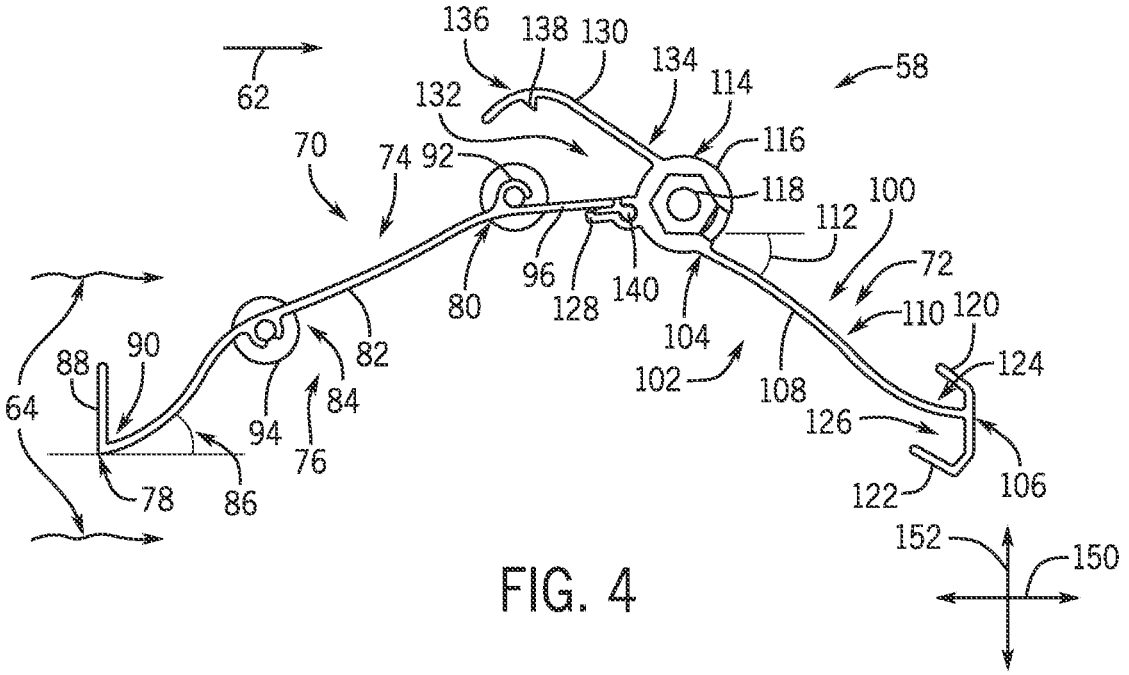
FIG. 4 is a side view of an embodiment of a louver blade in a first position, which may be employed in a louver assembly, in accordance with an aspect of the present disclosure.

FIG. 4 is a side view of an embodiment of one of the louver blades 58 of the louver assembly 50. The louver blade 58 may include a first segment 70 (e.g., blade segment, fixed segment, first portion, fixed portion, first section, upstream blade segment) and a second segment 72 (e.g., blade segment, movable section, second portion, movable portion, second section, downstream blade segment). The first segment 70 may include a first side, profile, or surface 74 (e.g., top side of the louver blade 58), a second side, profile, or surface 76 (e.g., bottom side of the louver blade 58) opposite the first side 74, a first end 78 (e.g., upstream end relative to a direction 62 of an air flow 64 directed across the louver blade 58), and a second end 80 (e.g., downstream end relative to the direction 62 of the air flow 64 directed across the louver blade 58).

The first side 74 and/or the second side 76 of the first segment 70 may have or define geometries, profiles, and/or features that are configured to block solid and/or liquid particles from passing through the louver assembly 50 (e.g., across the louver blade 58 in the direction 62) in an assembled configuration of the louver blade 58 with the frame assembly 52. For example, the first side 74 and/or the second side 76 of the first segment 70 may have a profile 82 (e.g., main body) extending between the first end 78 and the second end 80 of the first segment 70. The profile 82 may include a sloped portion 84 (e.g., angled portion, inclined portion) that is oriented at an angle 86 (e.g., an angle between approximately 20 degrees and approximately 60 degrees) relative to a horizontal axis 150 extending through the louver assembly 50. The sloped portion 84 may create a barrier (e.g., of the first side 74) configured to block a flow of solid and/or liquid particles and/or deflect solid and/or liquid particles away from the louver assembly 50, such as away from a space downstream of the louver assembly 50 relative to the direction 62 of the air flow 64 (e.g., toward an interior of the HVAC system 12).

In certain embodiments, the first segment 70 may also include a first extension 88 extending from the first end 78 (e.g., distal end, extending from the profile 82) of the sloped portion 84 in a direction (e.g., vertically upward direction) along a vertical axis 152 to block solid and/or liquid particles flowing toward the sloped portion 84 along the direction 62. The first extension 88 may also form a recess 90 (e.g., first recess, cavity, basin, trough) in the first side 74 of the first segment 70 between the first extension 88 and the sloped portion 84. Solid and/or liquid particles may impact and/or impinge against the sloped portion 84, and the sloped portion 84 may direct the solid and/or liquid particles to flow into the recess 90 via a gravitational force. The recess 90 may then guide the solid and/or liquid particles to flow (e.g., along a length or width of the louver blade 58) toward the jamb frame members 54 and out of the louver assembly 50 (e.g., instead of onto an adjacent louver blade 58), in the manner described above. For example, the channel 53 of each of the jamb frame members 54 may be configured to align with the recess 90 of the first segment 70 of the louver blade 58 to guide solid and/or liquid particles away from the louver assembly 50.

The first segment 70 of the louver blade 58 may also include one or more mounting portions (e.g., fixtures, mounting features, coupling portions, recesses, fastener receptacles) to facilitate mounting of the first segment 70 to and/or within the louver assembly 50 (e.g., frame assembly 52). The mounting portions may be positioned at any suitable location along the first segment 70. In some embodiments, the mounting portions may be formed along the sloped portion 84. For example, a first mounting portion 92 may be positioned on the first side 74 of the first segment 70 proximate the second end 80 of the first segment 70, and a second mounting portion 94 may be positioned on the second side 76 of the first segment 70 proximate the first end 78 of the first segment 70. The mounting portions 92, 94 may have any suitable shape and configuration. For example, in certain embodiments, the mounting portions 92, 94 may be a screw boss, a protrusion, and/or a retention passage configured to receive a fastener to mount the louver blade 58 to the louver assembly 50 (e.g., frame assembly 52). Additionally, in certain embodiments, the mounting portions 92, 94 may be configured to retain particles (e.g., liquid and/or solid particles captured by the louver blade 58) in a recess defined between the first segment 70 and the second segment 72, as described in greater detail below.

In certain embodiments, the first segment 70 may include additional features configured to block the flow of solid and/or liquid particles through the louver assembly 50. For example, in the illustrated embodiment, the first segment 70 includes a second extension 96 (e.g., at the second end 80, extending from the profile 82) that extends from the first mounting portion 92 toward the second segment 72. The second extension 96 may be configured to interact with an extension of the second segment 72 to retain solid and/or liquid particles collected by a recess defined between the first segment 70 and the second segment 72, as described in greater detail below.

The second segment 72 is adjustable (e.g., movable) relative to the frame assembly 52 and the first segment 70. For example, the second segment 72 may be configured to selectively contact the first segment 70, such as based on environmental conditions. That is, the second segment 72 (e.g., components thereof) may be configured to contact different components of the first segment 70 based on whether the second segment 72 is in the first position or the second position. The second segment 72 may include a first side, profile, or surface 100 (e.g., top side of the louver blade 58), a second side, profile, or surface 102 (e.g., bottom side of the louver blade 58) opposite the first side 100, a first end 104 (e.g., upstream end relative to the direction 62 of the air flow 64 directed across the louver blade 58), and a second end 106 (e.g., downstream end relative to the direction 62 of the air flow 64 directed across the louver blade 58). The first side 100 and/or the second side 102 may include or define geometries, profiles, and/or features that are configured to block solid and/or liquid particles from passing through the louver assembly 50 (e.g., across the louver blade 58 in the direction 62) in an assembled configuration of the louver blade 58 with the frame assembly 52. For example, the first side 102 and/or the second side 104 may have a profile 108 (e.g., main body) extending between the first end 104 and the second end 106 of the second segment 72. The profile 108 may include a sloped portion 110 (e.g., angled portion, declined portion) that is oriented at an angle 112 relative to the horizontal axis 150 extending through the louver assembly 50. In certain embodiments, movement or positional adjustment of the second segment 72 may enable adjustment of a magnitude of the angle 112. For example, the position of the second segment 72 and the magnitude of the angle 112 may be adjusted based on environmental conditions. The second segment 72 may be adjusted to extend into or away from a flow path of air between adjacent louver blades 58, as described in greater detail below.

The second segment 72 may include a joint 114 (e.g., mount) configured to couple (e.g., mount) the second segment 72 to the louver assembly 50 (e.g., frame assembly 52). The joint 114 may also be configured to enable positional adjustment of the second segment 72. For example, the joint 114 may enable rotation of the second segment 72 about the joint 114. To this end, the joint 114 may include a socket 116 and a fastener 118 (e.g., nut, bolt, pin) extending through the socket 116. Further, the socket 116 may be coupled (e.g., connected) to the profile 108 of the second section 72. In some embodiments, the socket 116 may be rotationally fixed relative to a portion of the profile 108.

In certain embodiments, the second end 106 of the second segment 72 may include a first extension 120 and a second extension 122. For example, the first extension 120 may extend from the first side 100 (e.g., extend from the profile 108) of the second segment 72 in a direction (e.g., at least partially in an upward direction with respect to gravity) at least partially along the vertical axis 152. The second extension 122 may extend from the second side 102 (e.g., extend from the profile 108) of the second segment 72 in a direction (e.g., at least partially downward direction with respect to gravity) at least partially along the vertical axis 152. The first extension 120 may define a first cavity (e.g., first recess) 124 on the first side 100 of the second segment 72 between the first extension 120 and the profile 108 proximate the second end 106 of the second segment 72, and the second extension 122 may define a second cavity (e.g., second recess) 126 on the second side 102 of the second segment 72 between the second extension 122 and the profile 108 proximate the second end 106 of the second segment 72. The first and second cavities 124, 126 may be configured to collect solid and/or liquid particles that impact and/or impinge against the louver blade 58 before directing the solid and/or liquid particles to flow toward the jamb frame members 54 and out of the louver assembly 50 in the manner described above. For example, the channel 59 of each of the jamb frame members 54 may be configured to align with the first and second cavities 122, 124 of the second segment 72 of the louver blade 58 to guide solid and/or liquid particles away from the louver assembly 50.

The second segment 72 also includes a third extension 128 extending from the profile 108 proximate the first end 100 of the second segment 72. The third extension 128 may extend in a direction (e.g., horizontal direction) toward the first section 70 while the louver blade 58 is in the first position shown in the illustrated embodiment. In certain embodiments, the third extension 128 is a portion of the profile 108 and thus may define a portion of the first end 100 of the second segment 72. Additionally or alternatively, the third extension 128 may extend from the socket 116 of the joint 114. As illustrated in FIG. 4, the third extension 128 of the second segment 72 may be configured to interact and/or engage with (e.g., abut) the second extension 96 of the first segment 70. In this way, the louver blade 58 may limit an amount of solid and/or liquid particles from passing through a gap formed between the first segment 70 and the second segment 72, as described in greater detail below.

The second segment 72 further includes a fourth extension 130 that at least partially defines a third cavity (e.g., third recess) 132 of the second segment 72. The fourth extension 130 may include a curvilinear profile, in some embodiments. For example, the fourth extension 130 may include a first portion 134 (e.g., flat portion) and a second portion 136 (e.g., hook portion) extending from a distal end of the first portion 134. As noted above, the second segment 72 is a movable segment of the louver blade 58 that may transition between (e.g., to and/or from) a first position or configuration, a second position or configuration, and/or any position (e.g., intermediate position) between the first position and the second position. In the first position shown in FIG. 4, the third cavity 132 is configured to capture solid and/or liquid particles during rainy and/or stormy conditions. That is, the third cavity 132 is arranged along the direction 62 of the air flow 64 through the louver assembly 50, such that solid and/or liquid particles entrained within the air flow 64 may be captured within the third cavity 132 by the fourth extension 130. The solid and/or liquid particles captured by the third cavity 132 may be directed toward the jamb frame members 54 and out of the louver assembly 50. For example, the channel 57 of each of the jamb frame members 54 may be configured to align with the third cavity 132 of the louver blade 58 to guide solid and/or liquid particles away from the louver assembly 50. It should be noted that the fourth extension 130 may be formed at any suitable location along the first segment 70 or the second segment 72. For example, while the fourth extension 130 is illustrated as extending from the joint 114, in certain embodiments, the fourth extension 130 may extend from the profile 82 of the first segment 70 or from the profile 108 of the second segment 72.

As illustrated in FIG. 4, with the louver blade 58 in the first position, the fourth extension 130, the third extension 128 of the second segment 72, and/or the second extension 96 of the first segment 70 may cooperatively define the third cavity 132. For example, the second extension 96 of the first segment 70 may extend from the first mounting portion 92 toward the third extension 128 of the second segment 72. The second portion 136 of the fourth extension 130 faces the air flow 64 flowing in the direction 62, which may include solid and/or liquid particles suspended within the air flow 64. As noted above, the solid and/or liquid particles may accumulate in the third cavity 132 before being directed toward the jamb frame members 54 and out of the louver assembly 50. In certain embodiments, the section portion 136 of the fourth extension 130 may include a protrusion 138 extending from the second portion 136 in a direction (e.g., downward direction) at least partially along the vertical axis 152. The protrusion 138 may be configured to guide, divert, and/or direct solid and/or liquid particles into the third cavity 132. Additionally, as noted above, the first segment 70 may include a protrusion configured to retain solid and/or liquid particles within the third cavity 132. In certain embodiments, the protrusion may be a component of and/or may extend from the first mounting portion 92. Thus, as illustrated in FIG. 4, the first mounting portion 92, the second extension 96 of the first segment 70, the third extension 128 of the second segment 72, and/or the fourth extension 130 may be arranged to define a depth and volume of the third cavity 132 to capture solid and/or liquid particles.

Figure 5:
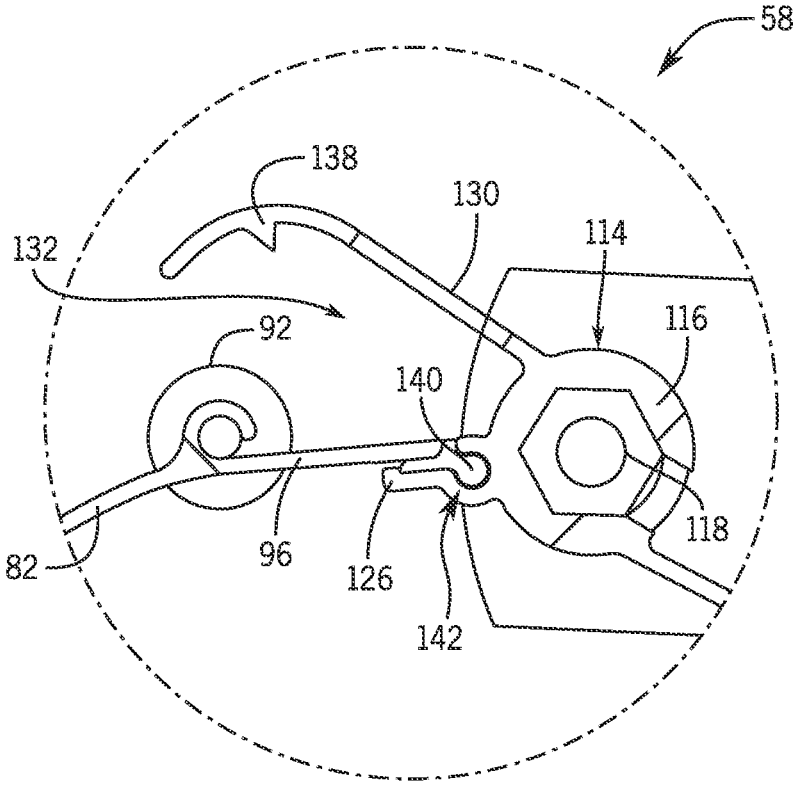
FIG. 5 is an expanded side view of an embodiment of a portion of the louver blade of FIG. 4 in the first position, in accordance with an aspect of the present disclosure.

In certain embodiments, each louver blade 58 may also include a seal 140 positioned between the second extension 96 of the first segment 70 and the third extension 126 of the second segment 72. The seal 140 may be configured to limit and/or block flow of fluid and/or particles between the first segment 70 and the second segment 72 and out of the third cavity 132. For example, FIG. 5 illustrates an embodiment of the louver blade 58 in the first position. As illustrated in FIG. 5, the seal 140 is disposed within (e.g., retained within) a recess 142 defined by the third extension 128 of the second segment 72. In this way, as the louver blade 58 transitions to the first position, the third extension 128 of the second segment 72 causes the seal 140 to engage with the second extension 96 of the first segment 70, thereby forming a seal (e.g., fluid-tight seal) between the first segment 70 and the second segment 72. In certain embodiments, the seal 140 may be disposed within a recess on the second extension 96 of the first segment 70, and rotation of the second segment 72 into the first position may cause the third extension 126 of the second segment 72 to engage with the seal 140. Still in other embodiments, respective seals 140 may be provided on (e.g., retained by) both the second extension 96 of the first segment 70 and the third extension 126 of the second segment 72.

As mentioned above, FIGS. 4 and 5 illustrate the louver blade 58 in the first position. The louver blade 58 may be configured to transition to the first position during rainy or stormy conditions and/or conditions in which enhanced blockage of fluid and/or solid particles through the louver assembly 50 is desired. As discussed herein, rainy or stormy conditions may refer to environmental conditions in which an amount of precipitation and/or an amount of wind is greater than a corresponding threshold value. When the louver blade 58 is in the first position, the second segment 72 of the louver blade 58 is positioned such that the second end 106 of the second segment 72 is in a lower limit position (e.g., lowermost position) with respect to gravity. Additionally, as illustrated in FIGS. 4 and 5, when the louver blade 58 is in the first position, the second extension 96 of the first segment 70 engages with the seal 140 disposed within the recess 142 of the third extension 128 of the second segment 72 to form a base of the third cavity 132. Further, the profiles 82 and 108 of the first and second segments 70 and 72, respectively, and the fourth extension 130 provide resistance to the air flow 64 flowing in the direction 62, thereby enabling collection of solid and/or liquid particles within the recess 90 of the first segment 70, the first cavity 124 of the second segment 72, the second cavity 126 of the second segment 72, and/or the third cavity 132. For example, as the air flow 64 impinges against the fourth extension 130, liquid and/or solid particles within the air flow 64 may be captured within the third cavity 132 and may be directed out of the louver assembly 50. Similarly, as the air flow 62 impinges against the profile 82 of the first segment 70 on the first side 74 of the first segment 70, the sloped portion 84 of the first segment 70 may direct the solid and/or liquid particles within the air flow 64 toward the recess 90, which may then deliver the solid and/or liquid particles out of the louver assembly 50 via the jamb frame members 54. Further still, as the air flow 64 impinges the profile 108 of the second segment 72 on the second side 102 of the second segment 72, the sloped portion 110 of the second segment 72 may direct solid and/or liquid particles within the air flow 64 toward the second cavity 126 of the second segment 72, which may then deliver the solid and/or liquid particles out of the louver assembly 50. In certain embodiments, the sloped portion 110 of the second segment 72 may receive solid and/or liquid particles falling from another louver blade 58 disposed above the louver blade 58 (e.g., relative to the vertical axis 152) and may direct the solid and/or liquid particles toward the first cavity 124 of the second segment 72 before directing the solid and/or liquid particles out of the louver assembly 50. Thus, the recess 90 of the first segment 70, the first cavity 124 of the second segment 72, the second cavity 126 of the second segment 72, and the third cavity 132 may act as reservoirs for capturing solid and/or liquid particles within the air flow 64. As mentioned above, each of the recess 90, the first cavity 124, the second cavity 126, and/or the third cavity 132 may be in fluid communication with the jamb frame members 54, thereby enabling delivery of the solid and/or liquid particles out of the louver assembly 50.

Figure 6:
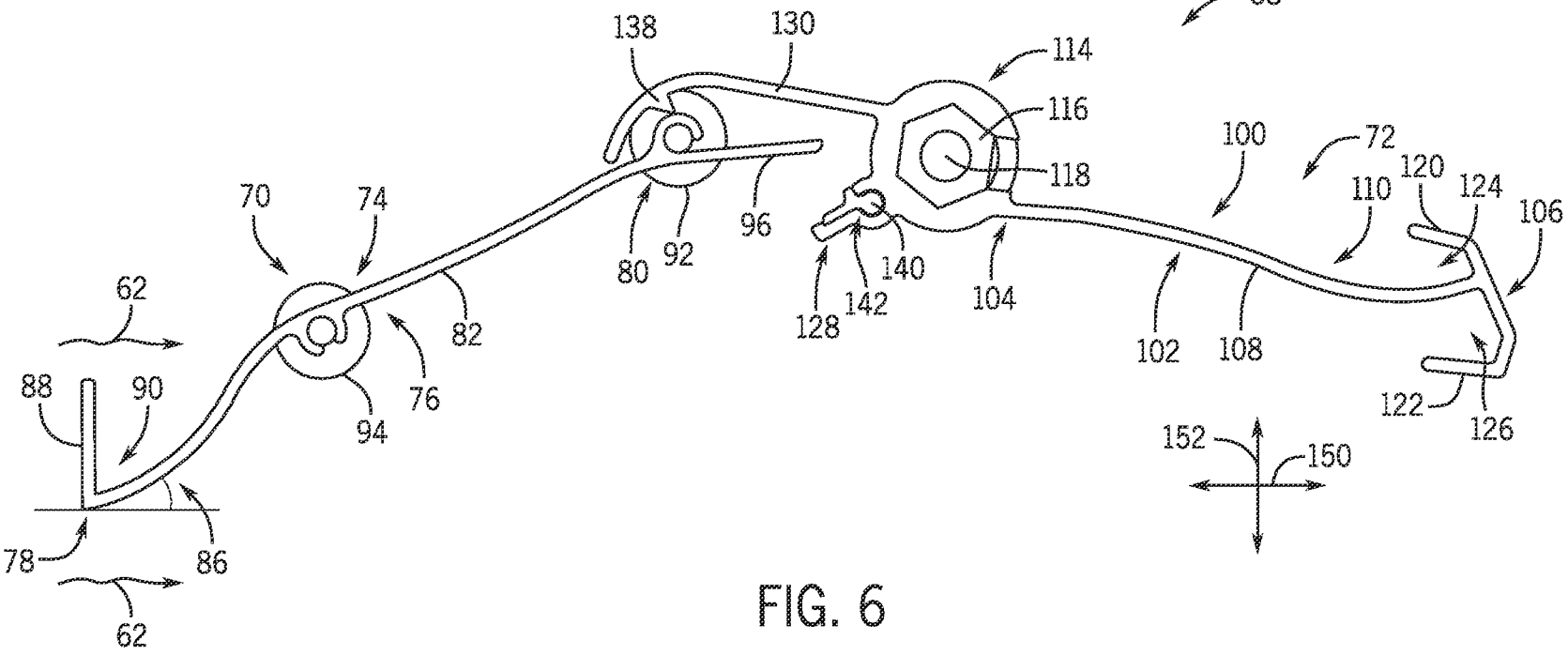
FIG. 6 is a side view of an embodiment of a louver blade in a second position, which may be employed in a louver assembly, in accordance with an aspect of the present disclosure.
Figure 7:
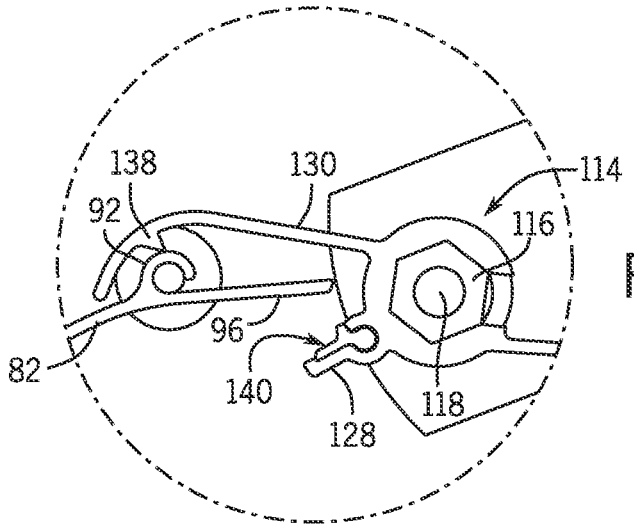
FIG. 7 is an expanded side view of an embodiment of a portion of the blade of FIG. 6 in the second position, in accordance with an aspect of the present disclosure.

Turning to FIGS. 6 and 7, a second position of the louver blade 58 is illustrated. The louver blade 58 may be transitioned to the second position in rainless and/or dry weather conditions and/or conditions in which increased flow of the air flow 64 through the louver assembly 50 is desired. As discussed herein, rainless and/or dry weather conditions may refer to environmental conditions in which an amount of precipitation or wind is below a corresponding threshold value. To transition to the second position, the second segment 72 is rotated such that the second end 106 of the second segment 72 is in an upper limit position (e.g., uppermost position) with respect to gravity. As illustrated, when the louver blade 58 transitions to the second position, the fourth extension 130 approaches and/or engages with the first segment 70. Thus, the upward movement of the second end 106 of the second segment 72 is limited by a travel distance of the fourth extension 130 to the first segment 70. For example, as the second segment 72 rotates into the second position (e.g., about the joint 114), the protrusion 138 of the fourth extension 130 may engage with the first mounting portion 92 of the first segment 70, thereby blocking further rotation of the second segment 72. Additionally, as the second segment 72 rotates into the second position, the third extension 128 of the second segment 72 rotates away from the second extension 96 of the first segment 70.

As illustrated in FIGS. 6 and 7, the third cavity 132 is closed or obstructed with the fourth extension 130 contacting the first mounting portion 92 of the first segment 70. Thus, the third cavity 132 may not induce resistance of the air flow 64 along the direction 62 and in certain embodiments, contact between the fourth extension 130 and the first mounting portion 92 of the first segment 70 may guide the air flow 64 across the louver blade 58. Further, as noted above, in the second position, the second end 106 of the second segment 72 is transitioned to an upper limit position such that an amount of surface area of the louver blade 58 within an air flow path through the louver assembly 50 and below the louver blade 58 is reduced. In this way, an amount of free area between adjacent louver blades 58 may be increased, thereby reducing a pressure drop across the louver assembly 50.

Figure 8:
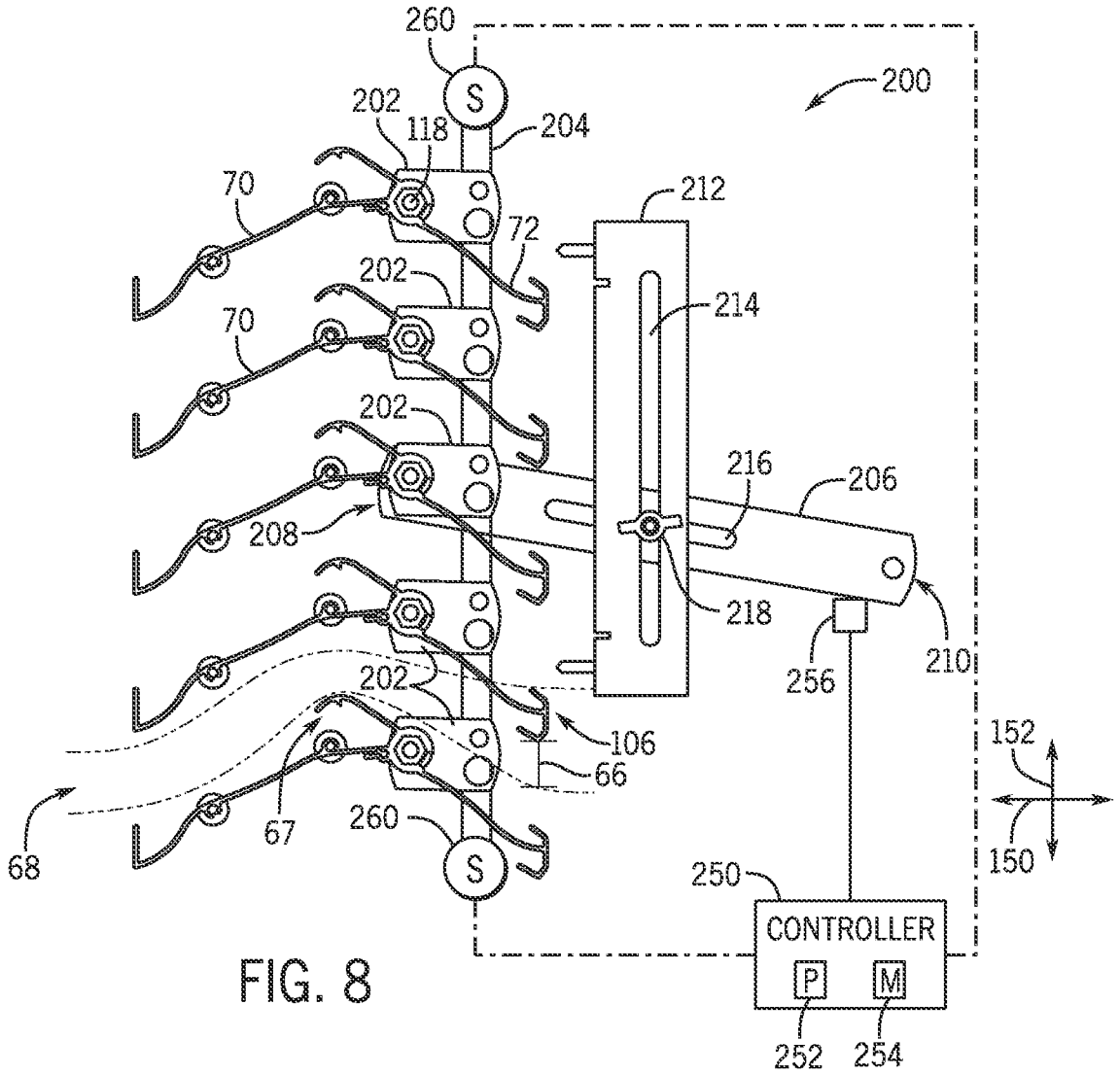
FIG. 8 is a schematic view of an embodiment of an assembly of louver blades in a first position and illustrating a linkage mechanism of the assembly, in accordance with an aspect of the present disclosure.
Figure 9:
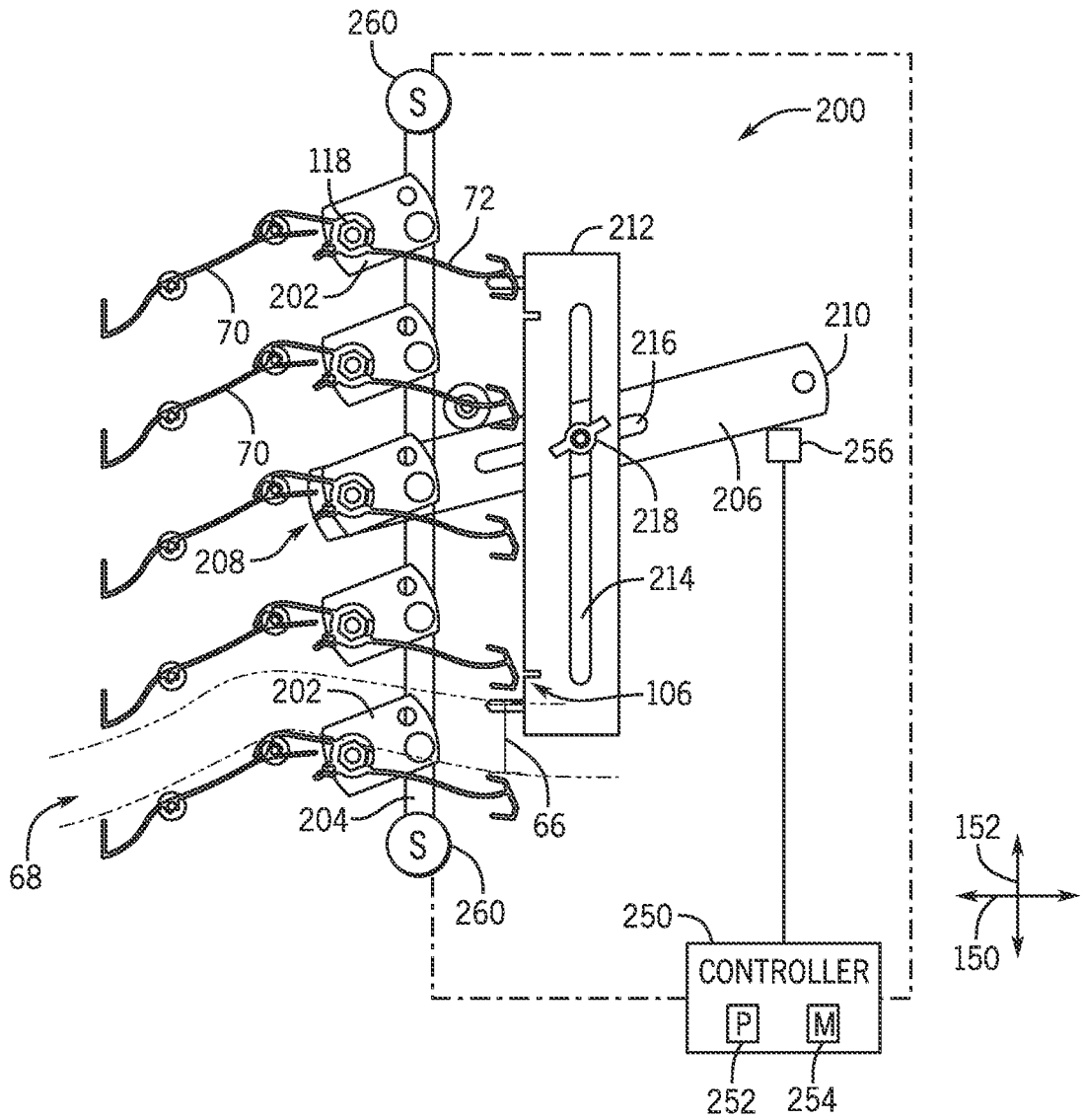
FIG. 9 is a schematic of an embodiment of an assembly of louver blades in a second position and illustrating a linkage mechanism of the assembly, in accordance with an aspect of the present disclosure.

In certain embodiments, each of the louver blades 58 within the louver assembly 50 may transition between the first position and the second position using a mechanical linkage mechanism (e.g., linkage assembly). For example, FIGS. 8 and 9 illustrate embodiments of a linkage assembly 200 that may be utilized to transition the louver assembly 50 between the first and second positions discussed above. In the illustrated embodiments, the linkage assembly 200 includes a plurality of link members 202 (e.g., links, joints, tabs, plates), and each link member 202 is coupled to the respective second segment 72 of one of the louver blades 58. For example, each link member 202 may be attached (e.g., rotationally fixed) to the fastener 118 corresponding to one of the louver blades 58 such that rotation of the link member 202 is imparted to the fastener 118, thereby inducing rotation of the fastener 118 and the second segment 72 of the corresponding louver blade 58.

The linkage assembly 202 further includes a tie bar 204 (e.g., linkage, connecting bar) attached to each of the link members 202 and a lever 206 coupled to the tie bar 204. A first end 208 of the lever 206 may be connected to a support via a pivot joint to enable rotation of the lever 206 about the pivot joint. In certain embodiments, the support may correspond to one of the jamb frame members 54 of the louver assembly 50 to which the louver blades 58 are coupled. In other embodiments, the support may correspond to the fasteners 118. Upon rotation of the lever 206 about the pivot joint, the tie bar 204 is translated in an upward or downward direction (e.g., along vertical axis 152), thereby causing the link members 202 to rotate along with the respective fasteners 118 coupled to the link members 202. As a result, the second segment 72 of each louver blade 58 may rotate in an at least partially upward or downward direction (e.g., between the first and second positions). For example, FIG. 8 illustrates the second segment 72 of each louver blade 58 in the first position, where an amount of free area 66 between adjacent louver blades 58 of the louver assembly 50 is reduced relative to the amount of free area 66 between adjacent louver blades 58 with the second segment 72 of each louver blade 58 in the second position (illustrated in FIG. 9). Indeed, as illustrated by FIG. 8, the second end 106 of each second segment 72 of a respective louver blade 58 is positioned in a lower limit position and extends beyond an apex 67 of an adjacent louver blade 58 positioned below the respective louver blade 58 in a direction (e.g., downward direction) along the vertical axis 152, such that the second segment 72 of each louver blade 58 extends into a flow path 68 defined between adjacent louver blades 58. In this way, the amount of free area 66 between adjacent louver blades 58 is reduced when the second segment 72 is in the first position relative to when the second segment 72 is in the second position.

To transition the second segments 72 of the louver blades 58 to the second position, a second end 210 of the lever 206 is translated in a vertical direction, thereby causing the lever 206 to rotate about the pivot joint. As the lever 206 rotates about the pivot joint, the tie bar 204 is translated in an upward direction (e.g., along vertical axis 152), thereby causing the link members 202 and the second segments 72 of the louver blades 58 to be rotated in an upward direction (e.g., counter clockwise direction). FIG. 9 illustrates the second segment 72 of each louver blade 58 in the second position, where the amount of free area 66 between adjacent louver blades 58 of the louver assembly 50 is increased relative to the amount of free area 66 between adjacent louver blades 58 with the second segment 72 of each louver blade 58 in the first position (illustrated in FIG. 8). Indeed, as illustrated by FIG. 9, the second end 106 of each second segment 72 of a respective louver blade 58 is positioned in an upper limit position and does not extend beyond the apex 67 of an adjacent louver blade 58 positioned below the respective louver blade 58 (e.g., in a downward direction along the vertical axis 152). In this way, the amount of free area 66 between adjacent louver blades 58 is increased when the second segment 72 is in the second position relative to when the second segment 72 is in the first position. To transition the second segments 72 to the first position, the second end 210 of the lever 206 may be translated in a downward direction (e.g., along vertical axis 152), thereby causing the tie bar 204 to also be displaced in in the downward direction. As the tie bar 204 is translated in the downward direction, the link members 202 and the second section 72 of each louver blade 58 are rotated in an at least partially downward direction (e.g., clockwise direction) to position the louver blades 58 in the first position.

Referring to FIGS. 8 and 9, in certain embodiments, the linkage assembly 200 includes a retention plate 212 (e.g., retainer, guide plate, fixed plate) configured to guide movement of the lever 206 and/or to enable selective retention of a position of the lever 206. In some embodiments, the retention plate 212 may be fixed relative to the frame assembly 52 and/or another component of the louver assembly 50. The retention plate 212 includes a first elongated slot 214, and the lever 206 includes a second elongated slot 216. A guide pin 218 (e.g., locking pin) may extend through the first and second elongated slots 214, 216. During actuation (e.g., translation) of the lever 206, the guide pin 218 may travel within and/or along the first and second elongated slots 214, 216. In this way, translation of the lever 206 may be restricted, such as along the vertical axis 152, relative to the retention plate 212, relative to the tie bar 204, and/or relative to the frame assembly 52. Accordingly, improved transition of the louver blades 58 between the first and second positions may be enabled. In certain embodiments, the guide pin 218 may include one or more mechanical fastener components, such as carriage bolt and a wing nut, which may enable retention and/or securement of the guide pin 218 within the first and second elongated slots 214, 216 at a desired position. In other words, the guide pin 218 may be actuated to adjustably fix or retain relative positions of the lever 206 and the retention plate 212 with respect to one another. In this way, a desired position of the lever 206 may be established and maintained to retain the louver blades 58 in the first position, in the second position, and/or at any intermediate position between the first position and the second position.

In certain embodiments, transition of the louver blades 58 between the first and second positions may be controlled in an automated manner. For example, the louver assembly 50 may include a controller 250 (e.g., control system, automation controller) that may be configured to enable adjustment (e.g., controlled adjustment, automatic adjustment) of a position of the louver blades 58. In some embodiments, the controller 250 may operate to adjust the louver blades 58 between the first and second positions based on data or feedback provided to the controller 250. To this end, the controller 250 may be communicatively coupled to one or more sensors 260 configured to detect environmental conditions associated with (e.g., adjacent) the louver assembly 50 and/or a system having the louver assembly 50. For example, the louver assembly 50 may include one or more of the sensors 260. The sensors 260 may include any suitable sensors configured to detect a parameter (e.g., an environmental condition) associated with operation and/or actuation of the louver assembly 50. In some embodiments, one or more of the sensors 260 may be configured to detect pressure (e.g., air pressure), moisture, temperature, air speed (e.g., flow rate, wind speed), light, vibrations, forces (e.g., haptic rain sensors), any other suitable sensor, or any combination thereof. The one or more sensors 260 may provide data and/or feedback indicative of one or more operating parameters (e.g., environmental conditions) to the controller 250. Based on the data and/or feedback from the sensors 260, the controller 250 may determine a desired position of the louver blades 58 and/or may transition the louver blades 58 of the louver assembly 50 to the desired position (e.g., first position or second position), as discussed further below. For example, based on the sensor data indicating that an operating parameter (e.g., amount of rainfall, a wind speed) of an environment surrounding the louver assembly 50 is above a threshold value, the controller 250 may be configured to transition the louver blade 58 to the first position. Conversely, based on the sensor data indicating that the operating parameter (e.g., amount of rainfall, wind speed) of the environment surrounding the louver assembly 50 is below the threshold value, the controller 250 may be configured to transition the louver blade 58 to the second position.

In certain embodiments, the controller 250 may include processing circuitry 252 (e.g., one or more microprocessors) and a memory 254. The processing circuitry 252 may include multiple microprocessors, one or more "general-purpose" microprocessors, one or more special-purpose microprocessors, and/or one or more application specific integrated circuits (ASICS), or some combination thereof. For example, the processing circuitry 252 may include one or more reduced instruction set (RISC) processors. The controller 250 may include non-transitory code or instructions stored on a machine-readable medium (e.g., the memory 254) that are executable by the processing circuitry 252 to implement the techniques disclosed herein. The memory 254 may include volatile memory, such as random-access memory (RAM), and/or non-volatile memory, such as read-only memory (ROM), optical drives, hard disc drives, solid-state drives, or any other non-transitory computer-readable medium storing instructions that, when executed by the processing circuitry 252, control operation of the louver assembly 50 in accordance with the present techniques. The controller 250 may be a component of the louver assembly 50 (e.g., a dedicated controller, a standalone controller). In other embodiments, the controller 250 may be a component of a system having the louver assembly 50. For example, the controller 250 may be a component of an HVAC system (e.g., HVAC unit 12) having the louver assembly 50.

The controller 250 may monitor and control the operation of the louver assembly 50, for example, by transitioning the louver blades 58 between the first and second positions. Indeed, in accordance with present techniques, the controller 250 may be configured to control the louver blades 58 of the louver assembly 50 to transition between the first and second positions described herein. Further, it should be appreciated that, while FIGS. 8 and 9 illustrate the linkage assembly 200 being coupled to the plurality of louver blades 58 within the louver assembly 50 via the tie bar 204, in other embodiments, the linkage assembly 200 may be individually coupled to each louver blade 58 within the louver assembly 50 to enable independent operation (e.g., positional adjustment) of each louver blade 58 and/or sets (e.g., subsets) of louver blades 58.

Further, in certain embodiments, the controller 250 may be configured to receive data from other sources or databases (e.g., external sources or databases), such as electronic news sources, social media sources, online weather sources, and/or any other information source that may be available via a network, the Internet, or other communication connection to which the controller 250 may be coupled. For example, the controller 250 may be configured to receive weather data from local and/or national weather stations, thereby enabling the controller 250 to preemptively transition the louver blades 58 of the louver assembly 50 to the first or second position based on expected or forecasted weather conditions. Thus, upon receipt of information (e.g., data) indicative of an approaching storm or adverse weather conditions, the controller 250 may transition the louver blades 58 from the second position to the first position to limit and/or block solid and/or liquid particles from passing through the louver assembly 50.

In certain embodiments, the controller 250 may be communicatively coupled to one or more actuators 256, which may be coupled to the lever 206. Thus, upon receiving an instruction (e.g., based on data from one of the sensors 260 and/or data received from an external source) from the controller 250 to transition the louver blades 58 of the louver assembly 50 to the first or second position, the actuators 256 may cause the lever 206 to move in an upward direction or downward direction to thereby cause the louver blades 58 to transition between the first and second positions. In other embodiments, the second segment 72 of each louver blade 58 may be associated with a respective actuator communicatively coupled to the controller 250, thereby enabling the controller 250 to individually control transition of each louver blade 58 between the first and second positions.

Figure 10:
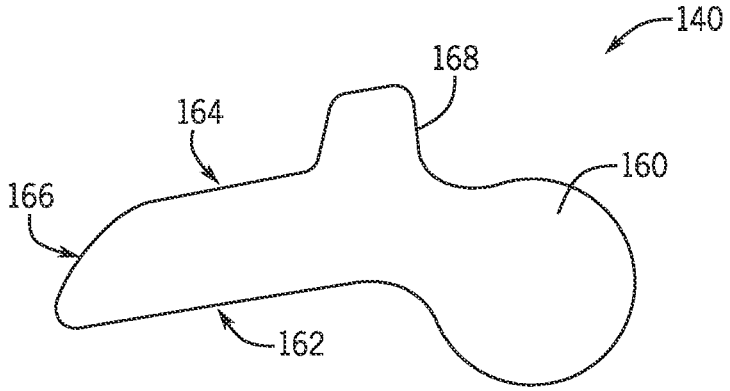
FIG. 10 is a schematic of an embodiment of a seal of a louver blade, in accordance with an aspect of the present disclosure.
Figure 11:
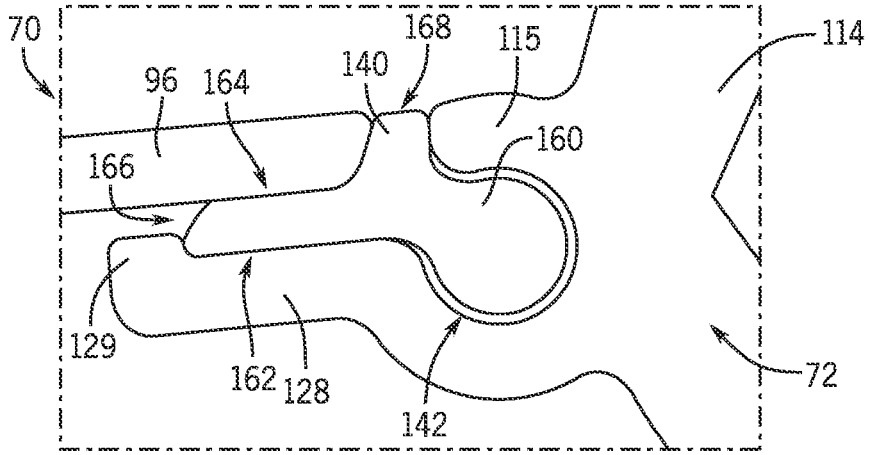
FIG. 11 is a schematic illustrating placement of an embodiment of a seal in a louver blade, in accordance with an aspect of the present disclosure.

FIG. 10 illustrates an embodiment of the seal 140 of the louver blade 58, and FIG. 11 illustrates an embodiment of the seal 140 installed with the louver blade 58. As noted above, the seal 140 is retained within the recess 142 on the third extension 128 of the second segment 72. In certain embodiments, respective geometries, shapes, and/or sizes of the seal 140 and the recess 142 are complementary to one another, thereby enabling the seal 140 to be retained within the recess 142 (e.g., in a desired position, with limited movement). As illustrated in FIGS. 10 and 11, the seal 140 includes a first portion 160 (e.g., bulging portion, expanded portion) that may be retained within the recess 142. The first portion 160 is configured to limit movement of the seal 140 relative to the recess 142, thereby facilitating retention of the seal 140 within the recess 142. The seal 140 further includes a first surface 162 (e.g., bottom surface, base), a second surface 164 (e.g., upper surface), and a third surface 166 (e.g., connecting surface). The first surface 162 may abut and/or engage with the third extension 128 of the second segment 72 to establish a sealing interface between the seal 140 and the third extension 128. In certain embodiments, the third extension 128 may include a lip 129 (e.g., retention portion) configured to retain the seal 140 within the recess 142. The second surface 164 may be configured to abut and/or engage with the second extension 96 of the first segment 70 with the louver blade 58 in the first position to establish a sealing interface between the seal 140 and the first segment 70. The third surface 166 extends from the first surface 162 to the second surface 164. The seal 140 may also include a protrusion 168. In certain embodiments, the protrusion 168 may extend from and/or may be positioned between the first portion 160 and the second surface 164. The protrusion 168 may be configured to extend within a passage formed between the second extension 96 of the first segment 70 and a projection 115 of the second segment 72 extending from the joint 114 when the louver blade 58 is in the first position. In this way, the protrusion 168 may establish a sealing interface between the first segment 70 and the second segment 72 to block flow of particles therebetween when the louver blade 58 is in the first position.

The present disclosure may provide one or more technical effects useful in the operation of an HVAC system. For example, an HVAC system may include a louver assembly configured to enable air flow between an interior and an exterior of an HVAC system or other enclosed space. The louver assembly may include louver blades having features configured to block solid and/or liquid particles from entering the HVAC system or enclosed space. In some embodiments, each louver blade may include various features, geometries, profiles, extensions, protrusions, and the like, that may block solid and/or liquid particles from flowing past the louver blade and through the louver assembly. Additionally, each louver blade may include one or more recesses configured to capture or retain the blocked solid and/or liquid particles and to direct the solid and/or liquid particles toward jamb frame members of the louver assembly that are configured to direct the solid and/or liquid particles out of the louver assembly. Further still, each of the louver blades may include a movable segment that is configured to transition between a first position that enables enhanced blockage of liquid and/or solid particles through the louver assembly and a second position that enables improved air flow through the louver assembly. The positions of the louver blades may be adjusted based on environmental conditions, which may be detected by one or more sensors. Accordingly, the size of an opening formed between adjacent louver blades may be increased or decreased. In this way, the louver blades may enable air flow through the louver assembly at a desirable flow rate during certain (e.g., temperate, non-stormy) environmental conditions, such as to enable efficient operation of an HVAC system. During other (e.g., inclement, stormy) environmental conditions, the movable segment of each louver blade may transition to a second position that decreases an amount of air flow through the louver assembly and increases blockage solid and/or liquid particles through the louver assembly. The technical effects and technical problems in the specification are examples and are not limiting. It should be noted that the embodiments described in the specification may have other technical effects and can solve other technical problems.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A louver blade for a louver assembly, the louver blade comprising:

a first segment;

a second segment, wherein the second segment is adjustable relative to the first segment to selectively contact the first segment, the second segment moveable between a first position and a second position, wherein the second segment reduces an amount of free area between adjacent louver blades of the louver assembly in the first position, and wherein the second segment increases the amount of free area between adjacent louver blades of the louver assembly in the second position;

a first extension of the first segment;

a second extension of the second segment; and a seal disposed within a recess of the second extension, wherein, in the first position of the second segment, the seal engages the first extension of the first segment.

2. The louver blade of claim 1, wherein the first segment is configured to be fixed relative to a frame of the louver assembly.

3. The louver blade of claim 1, wherein the second segment is configured to rotate relative to the first segment to transition between the first position and the second position.

4. The louver blade of claim 1, wherein the second segment comprises:

a joint configured to rotatably couple the second segment to a frame of the louver assembly; and the second extension extending from the joint, wherein, in the first position of the second segment, the second extension at least partially defines a recess between the first segment and the extension, and wherein the second extension is configured to guide particles into the recess in an installed configuration of the louver blade with the louver assembly.

5. The louver blade of claim 4, wherein, in the second position of the second segment, the second extension contacts the first segment and to guide an air flow across the louver blade.

6. The louver blade of claim 1, wherein, in the second position of the second segment, the seal is disengaged from the first extension.

7. The louver blade of claim 6, wherein the first segment comprises a mounting portion configured to enable securement of the first segment to a frame of the louver assembly, and the second extension contacts the mounting portion in the second position.

8. The louver blade of claim 1, wherein the first segment is an upstream blade segment and the second segment is a downstream blade segment, relative to a direction of air flow through the louver assembly.

9. A louver assembly for a heating, ventilation, and air conditioning (HVAC) system, the louver assembly comprising:

a louver blade comprising a first segment and a second segment, wherein the second segment is adjustable, relative to the first segment, between a first position and a second position, the second segment movable between a first position and a second position, wherein the second segment reduces an amount of free area through the louver assembly, and wherein the second segment is increases the amount of free area through the louver assembly in the second position;

a controller configured to control transition of the second segment between the first position and the section position; and a sensor communicatively coupled to the controller, wherein the sensor is configured to collect data indicative of an operating parameter of an environment surrounding the louver assembly, and the controller is configured to control transition of the louver blade between the first position and the second position based on the data.

10. The louver assembly of claim 9, wherein the operating parameter is indicative of an amount of rainfall of the environment, and the controller is configured to:

control transition of the second segment to the first position based on the data indicating that the amount of rainfall is greater than a threshold value; and control transition of the second segment to the second position based on the data indicating that the amount of rainfall is less than the threshold value.

11. The louver assembly of claim 9, wherein the operating parameter is indicative of a wind speed of the environment, and controller is configured to:

control transition of the second segment to the first position based on the data indicating that the wind speed is greater than a threshold value; and control transition of the second segment to the second position based on the data indicating that the wind speed is less than the threshold value.

12. The louver assembly of claim 9, wherein the second segment comprises an extension, the extension at least partially defining a recess in the first position, and wherein the recess is configured to capture solid particles or liquid particles directed into the louver assembly.

13. The louver assembly of claim 12, comprising a frame assembly, wherein the frame assembly comprises a jamb frame member coupled to the louver blade, the jamb frame comprises a channel that aligns with the recess to receive the solid particles or the liquid particles from the recess.

14. The louver assembly of claim 9, wherein the louver blade comprises a seal positioned within a recess of the second segment, wherein the seal is engages with an extension of the first segment to establish a sealing interface between the first segment and the second segment in the first position of the second segment.

15. A louver blade for a louver assembly, wherein the louver blade comprises:

an upstream segment comprising a first extension;

a downstream segment comprising a second extension and a third extension, wherein the downstream segment is configured to rotate relative to the upstream segment between a first position and a second position; and a seal disposed within a recess of the second extension, wherein the seal is engages with the first extension of the upstream segment in the first position of the downstream segment, wherein the downstream segment reduces an amount of free area through the louver assembly in the first position and increases the amount of free area through the louver assembly in the second position.

16. The louver blade of claim 15, wherein the first extension, the second extension, the third extension, and the seal collectively define a cavity configured to collect particles in the first position of the downstream segment.

17. The louver blade of claim 15, wherein the third extension is contacts a mounting portion of the upstream segment in the second position of the downstream segment to limit rotation of the downstream segment beyond the second position and away from the first position.

* * * * *